United States Patent [19]

Patera et al.

[11] Patent Number: 4,927,033

[45] Date of Patent: May 22, 1990

[54] REMOVABLE ARTICLE HOLDER FOR A DISHWASHER

[75] Inventors: Ginger E. Patera, Lincoln Township, Berrien County; Larry L. Janke; William T. Lampman, both of Joseph Township, Berrien County, all of Mich.

[73] Assignee: Whirlpool Corporation, Benton Harbor, Mich.

[21] Appl. No.: 292,262

[22] Filed: Dec. 30, 1988

[51] Int. Cl.[5] ..... A47F 7/00

[52] U.S. Cl. ..... 211/41; 220/19

[58] Field of Search ..... 211/74, 41, 181, 183; 220/19

[56] References Cited

U.S. PATENT DOCUMENTS

| | | | |
|---|---|---|---|
| 2,677,468 | 5/1954 | Dreyfus | 211/71 |
| 2,708,037 | 5/1955 | Planeta | 211/41 X |
| 2,841,288 | 7/1958 | Field et al. | 211/41 |
| 3,289,854 | 12/1966 | Kauffman | 211/41 |
| 3,451,556 | 6/1969 | Macoicz | 211/41 |

*Primary Examiner*—Robert W. Gibson, Jr.

*Attorney, Agent, or Firm*—Mason, Kolehmainen, Rathburn & Wyss

[57] ABSTRACT

An article holder for the dish rack of a dishwasher is provided for securely holding cup-shaped articles. The article holder includes a hinge member for removably interconnecting said article holder to a horizontally extending tine of the dish rack. The article holder also includes an article engaging member that extends generally vertically with respect to the interconnecting member of the article holder. A curvelinear biasing member of the article holder is interposed between the interconnecting member and the article engaging member for resiliently biasing the article engaging member against an article, holding a wall of the article between the holder's article engaging member and a dish rack member.

33 Claims, 2 Drawing Sheets

REMOVABLE ARTICLE HOLDER FOR A DISHWASHER

BACKGROUND OF THE INVENTION

1. Field of the Invention

The present invention relates to an article holder for a basket or dish rack and more particularly to a removable article holder for securing cup-shaped articles and the like to the dish rack of a dishwasher.

2. Description of the Prior Art

Known dishwashers typically include a first dish rack, typically an upper dish rack, for supporting cups, containers and similar articles and a second dish rack, typically a lower dish rack, for supporting plates, pots, pans, and other large articles. Water pressure on cup-shaped articles especially lightweight plastic articles, in either dish rack during the operation of the dishwasher often causes the articles to turn over landing either upright or in an unstable position. When turned over during the operation of the dishwasher, a cup-shaped article will collect dirty water in its base so that the article is not cleaned. Further, the unstable position in which the article lands may result in the article tipping over as the dishwasher is opened so that the article dumps dirty water onto clean dishes or onto the user of the dishwasher.

Dish racks are known to have various members for supporting dishes and glasses as follows. U.S. Pat. No. 2,516,088 shows pivotal dish supporting elements in a folding dish drying rack. U.S. Pat. No. 2,629,498 shows individual curved members each for supporting a dish at a plurality of points wherein the members may be hooked together to form a modular dish rack. U.S. Pat. No. 2,708,037 shows a detachable rack for draining glasses in a dish rack, the detachable draining rack having large upstanding members to support large glasses and smaller upstanding members positioned in a plane slightly offset from the large members so that the rim of a small glass may be gripped between a large and small member. U.S. Pat. No. 3,451,556 shows a removable article supporting device for a dish rack. The supporting device is U-shaped having indentations in each leg near the base of the device so as to engage adjacent parallel tines in the base of the dish rack. U.S. Pat. No. 3,752,322 shows a dish rack with spaced pins that are pivotal to various positions including intermediate inclined positions in which the pins press against the outer surface of an article to be held in place on the rack. U.S. Pat. No. 4,046,261 shows a dishwasher rack with removable fences for supporting glasses and dishes.

None of the known glass/dish supporting devices for dish racks provides a resilient bias for affirmatively securing a cup or the like between the supporting device and a member of the dish rack that extends above a horizontal tine of the dish rack to which the holder is removably secured.

SUMMARY OF THE INVENTION

In accordance with the present invention, the disadvantages of prior art glass/dish supporting devices for the dish rack of a dishwasher have been overcome. The dish rack article holder of the present invention includes a member for removably interconnecting the holder with a horizontally extending tine of a dish rack; a member for engaging an article, the article engaging member extending generally vertically with respect to the interconnecting member; and a member interposed between the interconnecting member and the article engaging member for resiliently biasing the article engaging member of the holder towards a dish rack member that extends above the horizontal tine to which the holder is attached to resiliently grip a wall of an article between the article engaging member and the dish rack member.

More particularly, the biasing member of the article holder of the present invention is curvelinear having a first linear portion extending outwardly from the interconnecting member of the holder, a curved portion curving upwardly and inwardly from the first linear portion, and a second linear portion extending inwardly from the first curved portion. The second linear portion of the biasing means extends inwardly into a knee or curved portion of the article engaging member, the knee curving generally upwardly. The second linear portion of the biasing member extends inwardly a greater distance than the distance that the first linear portion extends outwardly to position the knee of the article engaging member inwardly of the interconnecting member so that when the holder is attached to a horizontal tine of the dish rack, the knee of the article engaging member is resiliently biased towards the dish rack member.

The interconnecting member of the article holder includes a hinge member to allow the article holder to pivot about the horizontal tine of the dish rack. The hinge member further snaps onto the horizontal tine so as to allow the article holder to be easily attached and removed from the dish rack.

The interconnecting member, article engaging member and biasing member are integrally formed to provide an article holder having a unitary construction. Further, the article holder is formed of a resilient material such as plastic so as to resiliently hold articles between the article engaging member and the dish rack.

The dish rack article holder of the present invention securely holds cup-shaped articles in position to prevent such articles from turning over during the operation of a dishwasher. These and other objects, advantages and novel features of the present invention, as well as details of an illustrated embodiment thereof, will be more fully understood from the following description and the drawing.

BRIEF DESCRIPTION OF THE DRAWING DRAWINGS

DESCRIPTION OF THE PREFERRED EMBODIMENT

Figure 1:
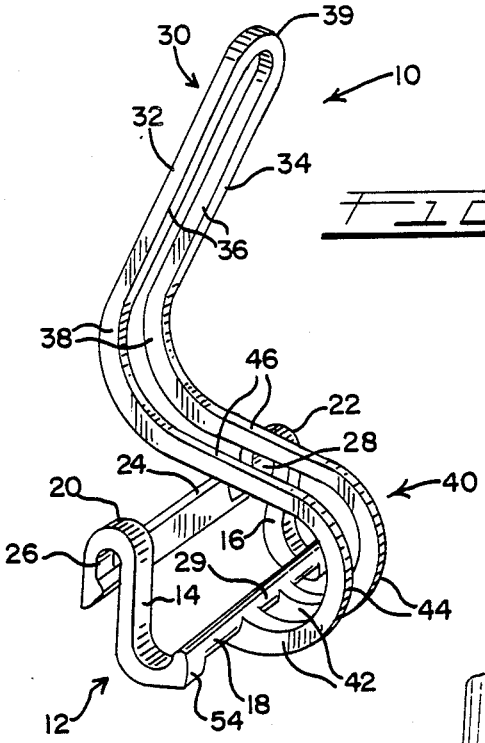
FIG. 1 is a perspective view of a dish rack article holder constructed in accordance with the principles of the present invention.
Figure 3:
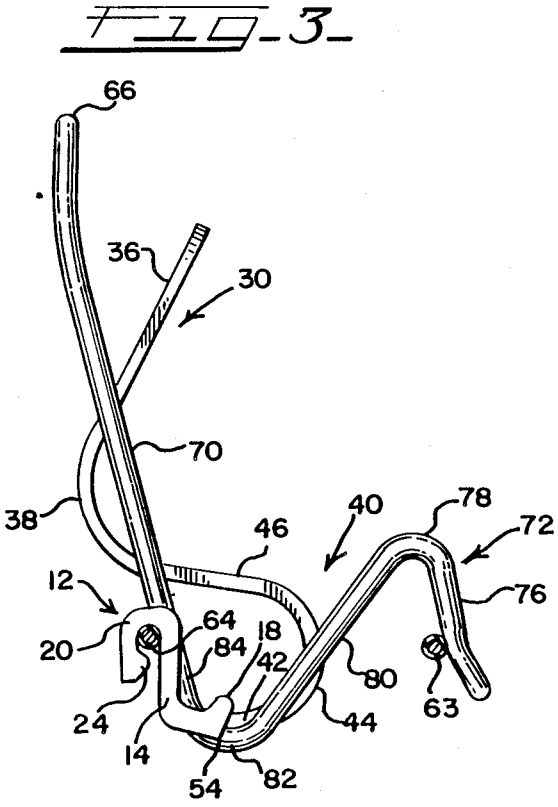
FIG. 3 is a side view of the article holder and dish rack shown in FIG. 2.
Figure 2:
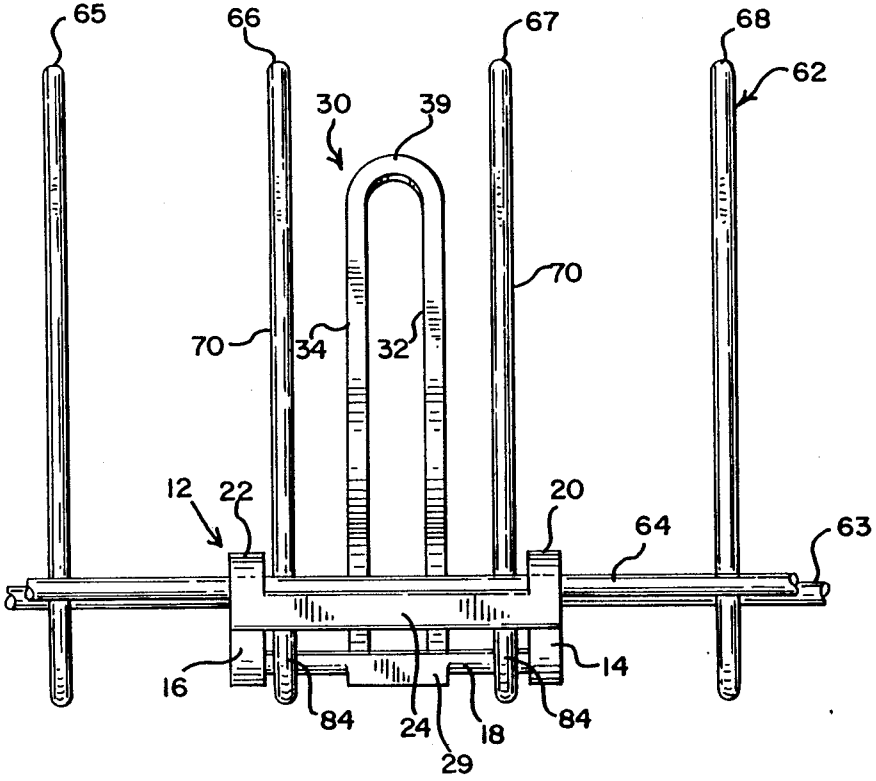
FIG. 2 is a rear view of the article holder shown in FIG. 1 attached to a first dish rack.

A removable article holder 10, shown in FIGS. 1, 2 and 3 and constructed in accordance with the principles of the present invention, is particularly well suited for securing cup-shaped articles to a dish rack, such as an upper dish rack 62 (FIGS. 2 and 3) or dish rack 17 (FIGS. 3 and 4), of a dishwasher. The article holder 10, however, may be employed with any dish rack or basket having at least one horizontally extending tine and a member or members extending above the tine as will be apparent from the following description of the article holder 10.

The article holder 10 includes a hinge member 12 for removably interconnecting the article holder with a horizontal tine 13 of a dish rack 17. The hinge member 12 has a pair of curved members 14 and 16 that extend from opposite sides of a base crossbar 18 curving upwardly to respective inverted U-shaped ends 20 and 22 that are connected by a second crossbar 24. The crossbar 24 and the U-shaped ends 20 and 22 form apertures 26 and 28 into which the horizontal tine 13, 64 of the dish rack 17, 62 snaps, the article holder 10 being securely attached to the tine 13, 64 by the crossbar 24 which extends inwardly towards the members 14 and 16 to substantially encircle the tine 13, 64 with the U-shaped ends 20 and 22. When snapped onto a horizontal tine 13, 64, the article holder 10 is pivotable thereabout. The central portion 29 of the base crossbar 18 is formed having a greater cross-section than the remainder of the crossbar to form a stop for the article holder 10 when used on the dish rack 17 as described below.

The article holder 10 includes an article engaging member 30 that extends generally vertically with respect to the hinge member 12. The article engaging member 30 has parallel legs 32 and 34 each having a linear portion 36 that extends upwardly and outwardly from a respective curved portion or knee 38, wherein the linear portions 36 extend upwardly into a curved portion 39 so as to join the legs 32 and 34 together at their upper ends. The linear portions 36 of the legs 32 and 34 fit into the interior of an inverted cup-shaped article with the knees 38 of the legs 32 and 34 abutting a sidewall of the article as discussed below with reference to FIG. 3.

The parallel legs 32 and 34 also form part of a bias member 40 of the article holder 10. Each of the legs 32 and 34 of the bias member 40 has a first linear portion 42 that extends outwardly from the base crossbar 18 on opposite sides of the central portion 29 of the crossbar 18. The first linear portion 42 of each of the legs 32 and 34 extends outwardly into a respective curved portion 44 that curves upwardly and inwardly therefrom. The curved portion 44 of each of the legs 32 and 34 extends into a second linear portion 46 of the bias member 40. Each of the second linear portions 46 extends inwardly, in the direction of arrow A, from the curved portions 44 a greater distance than the distance that the first linear portions 42 extends outwardly, in the direction of arrow B, from the base crossbar 18 so that the knees 38 of the holder's article engaging member 30 are positioned inwardly of the hinge member 12 as shown in FIG. 4.

The hinge member 12, the biasing member 40 and the article engaging member 30 of the article holder 10 are integrally formed to provide a unitary construction. Further, the article holder 10 is formed of a resilient material such as plastic so as to resiliently bias the article engaging member 30 against an article secured thereby to a dish rack 17, 64.

Figure 4:
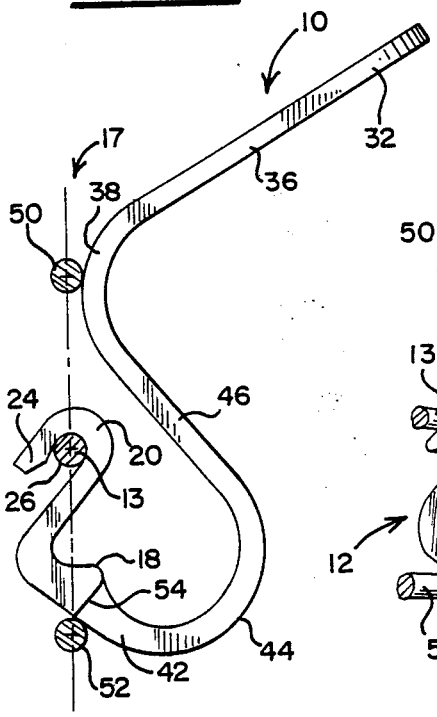
FIG. 4 is a side view of the article holder shown in FIG. 1 attached to a second dish rack.
Figure 5:
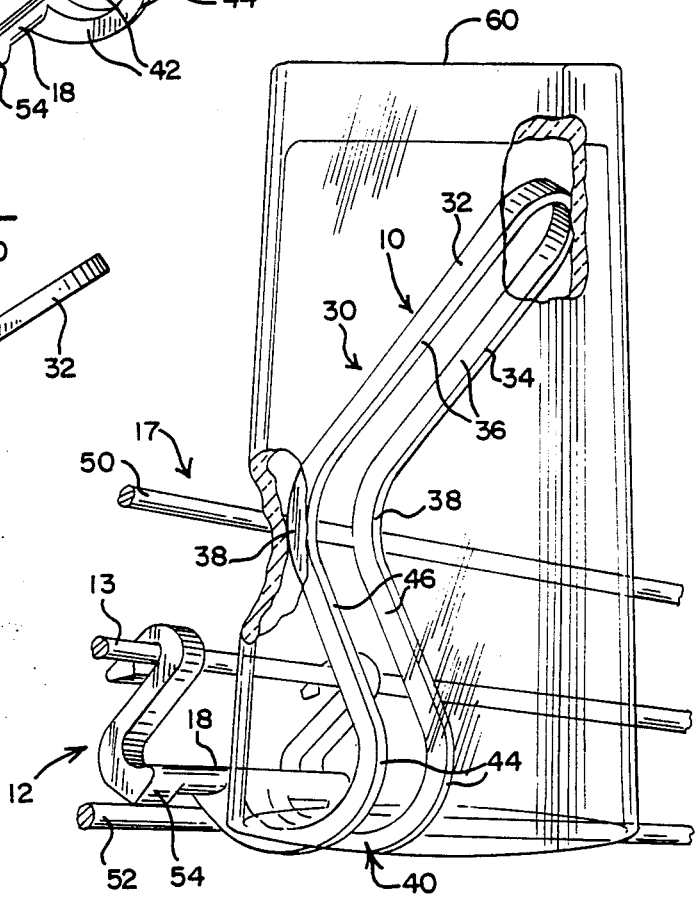
FIG. 5 is a perspective view of the article holder and dish rack shown in FIG. 4 holding a cup.

The article holder of the present invention may be secured to different dish racks, one of which, the dish rack 62 is shown in FIGS. 2 and 3 and another of which, the dish rack 17 is shown in FIGS. 4 and 5. Each of the dish racks 17 and 62 has a respective horizontally extending tine 13, 64 onto which the hinge member 12 is snapped and a member 50 or members 66, 67 extending above the respective horizontal tine 13, 64 to allow an article to be secured to the dish rack 17, 62 with a wall of the article resiliently gripped between the article holder 10 and the upper member 50 or members 66, 67.

As can be seen in FIGS. 2 and 3, the dish rack 62 includes a pair of spaced, horizontally extending tines 63 and 64 and a number of spaced, perpendicular tines 65, 68, each of which is joined to the horizontal tines 63 and 64. More particularly, each of the tines 65–68 includes a generally vertically extending linear portion 70 and a generally S-shaped portion 72. The S-shaped portion 72 has a linear portion 76 that is attached to the horizontal tine 63 and extends into a curved portion 78, the curved portion 78 curving downward into a second linear portion 80 that extends into a second curved portion 82, the second curved portion 82 curving upward into a third linear portion 84 that extends upward from below the horizontal tine 64 into the linear portion 70 where the tine 65–68 is joined to the horizontal tine 64. To use the article holder 10 with the dish rack 62, the article holder 10 is slipped over a pair of adjacent upwardly extending tines 66 and 67 so that the tines 66 and 67 are positioned between the crossbars 18 and 24. The hinge member 12 is then snapped onto the horizontal tine 64. The article holder 10 pivots in a clockwise direction about the tine 64, as shown in FIG. 3, until the crossbar 18 abuts the linear portion 84 of the tines 66 and 67. When the article holder is mounted as such onto the dish rack 62, the knees 38 of the holder's article engaging member 30 extend between the linear portions 70 of the tines 66 and 67. To secure a glass or other container or cup-shaped article to the dish rack 62, the glass is inverted, i.e., turned upside down, and inserted over the article engaging member 30 so that the linear portion 36 of the article holder 10 extends into the interior of the glass. The glass is slid down over the article engaging member 30 until a portion of the rim of the glass abuts the crossbar 18 with the knees 38 of the article holder 10 engaging an inner side wall of the glass to hold the glass between article engaging member 30 of the article holder 10 and the upwardly extending tines 66 and 67 of the dish rack 62. A glass secured to the dish rack 62 is resiliently gripped between the tines 66 and 67 and the knees 38 of the article engaging member 30 with the forces acting on the glass distributed between four radial arcs. Fragile glasses or containers are thus gently but securely held in the dish rack 62.

When the article holder 10 is used in a dishwasher to secure a cup or a glass 60 to a dish rack 17 as shown in FIGS. 4 and 5, the hinge member 12 is snapped onto a horizontal tine 13 of the dish rack 17 of the dishwasher. The article holder 10 pivots around the tine 13 until the central portion 29 of the base crossbar 18 and the ends 54 and 56 of the members 14 and 16 abut a dish rack member, such as the horizontal tine 52, vertically displaced below the tine 13, the central portion 29 and ends 54 and 56 of the members 14 and 16 stopping the pivotal movement of the article holder 10. When the article holder 10 is mounted as such onto the dish rack 17, the knees 38 of the holder's article engaging member 30 are resiliently biased by the biasing member 40 against the horizontal tine 50 to exert a horizontal force perpendicular to the tine 50. To secure a glass 60 or other container or cup-shaped article to the dish rack 17, the article engaging portion 30 of the article holder 10 is moved outwardly and the cup 60 turned upside down and inserted over the article engaging member 30 so that the knees 38 of the article holder 10 engage an inner sidewall 62 of the cup 60 holding the cup 60 between the article engaging member 30 of the article holder 10 and the vertically displaced dish rack tine 50. Because the linear portions 36 of the article holder 10 extend a distance into the inverted cup, when the knees of the holder 10 are resiliently biased against the inner sidewall of the cup 60, the cup 60 is held firmly in place and prevented from turning over and collecting dirty water during the operation of the dishwasher.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1. An article holder for securing an article in a basket having at least one horizontally extending tine and at least one member extending above said tine comprising:

means for interconnecting said article holder with said basket tine;

means extending generally vertically with respect to said interconnecting means for engaging an article; and means interposed between said interconnecting means and said article engaging means for resiliently biasing said article engaging means towards said basket member to resiliently hold a portion of said article between said article engaging means and said basket member.

2. An article holder for securing an article in a basket as recited in claim 1 wherein said interconnecting means, article engaging means and biasing means are integrally formed to provide a unitary construction.

3. An article holder for securing an article in a basket as recited in claim 2 wherein said interconnecting means, article engaging means and biasing means are integrally formed of a resilient material.

4. An article holder for securing an article in a basket as recited in claim 1 wherein said biasing means in an operative orientation has a first linear portion extending outwardly from said interconnecting means, a curved portion curving upwardly and inwardly from said first linear portion and a second linear portion extending inwardly from said first curved portion, said article engaging means having a curved portion curving generally upwardly from said second linear portion of said biasing means.

5. An article holder for securing an article in a basket as recited in claim 4 wherein said second linear portion of said biasing means extends inwardly a greater distance than the distance that said first linear portion extends outwardly such that the curved portion of said article engaging means is positioned inwardly of said interconnecting means.

6. An article holder for securing an article in a basket as recited in claim 5 wherein said interconnecting means, said first and second linear portions of said biasing means, said curved portion of said biasing means and said article engaging means are integrally formed of a resilient material.

7. An article holder for securing an article in a basket as recited in claim 4 wherein said article engaging means includes a linear portion extending upwardly and slightly outwardly from said curved portion of the article engaging means.

8. An article holder for securing an article in a basket as recited in claim 1 wherein said article engaging means includes a knee portion extending from said biasing means to exert a horizontal force perpendicular to said basket member.

9. An article holder for securing an article in a basket as recited in claim 1 wherein said interconnecting means includes means for snapping said article holder onto said basket tine so as to allow said article holder to be removed from said basket

10. An article holder for securing an article in a basket as recited in claim 1 wherein said interconnecting means includes a hinge member for interconnecting said article holder with s id basket tine such that said article holder is pivotable about said basket tine.

11. An article holder for a dish rack having at least one horizontally extending tine and at least one member extending above said tine comprising:

means for removably interconnecting said article holder with said dish rack tine;

means extending generally vertically with respect to said interconnecting means for engaging an article; and means interposed between said interconnecting means and said article engaging means for resiliently biasing said article engaging means towards said dish rack member to resiliently hold a portion of said article between said article engaging means and s id dish rack member.

12. An article holder for a dish rack as recited in claim 11 wherein said interconnecting means, article engaging means and biasing means are integrally formed to provide a unitary construction.

13. An article holder for a dish rack as recited in claim 12 wherein said interconnecting means, article engaging means and biasing means are integrally formed of a resilient material.

14. An article holder for a dish rack as recited in claim 11 wherein said biasing means in an operative orientation has a first linear portion extending outwardly from said interconnecting means, a curved portion curving upwardly and inwardly from said first linear portion and a second linear portion extending inwardly from said first curved portion, said article engaging means having a curved portion curving generally upwardly from said second linear portion of said biasing means.

15. An article holder for a dish rack as recited in claim 14 wherein said second linear portion of said biasing means extends inwardly a greater distance than the distance that said first linear portion extends outwardly such that the curved portion of said article engaging means is positioned inwardly of said interconnecting means.

16. An article holder for a dish rack as recited in claim 15 wherein said interconnecting means, said first and second linear portions of said biasing means, said curved portion of said biasing means and said article engaging means are integrally formed of a resilient material.

17. An article holder for a dish rack as recited in claim 14 wherein said article engaging means includes a linear portion extending upwardly and slightly outwardly from said curved portion of the article engaging means.

18. An article holder for a dish rack as recited in claim 11 wherein said article engaging means includes a knee portion extending from said biasing means to exert a force on said article.

19. An article holder for a dish rack as recited in claim 11 wherein said interconnecting means includes a hinge member for interconnecting said holder with said dish rack tine such that said article holder is pivotable about said dish rack tine.

20. An article holder for a dish rack as recited in claim 19 wherein said hinge member is adapted to be snapped onto said horizontal tine so as to be removably interconnected with said tine.

21. An article holder for securing a cup-shaped article to a dish rack, said cup-shaped article having a sidewall defining the interior of the article, said dish rack having at least one horizontally extending tine and at least one member extending above said tine comprising:

means for interconnecting said holder with said dish rack;

means for engaging a cup-shaped article, said article engaging means having a knee portion curving generally upwardly into a linear portion; and means for biasing said knee portion of said article engaging means towards said dish rack member to hold the sidewall of the cup-shaped article between said knee portion and said dish rack member with the linear portion of said article engaging means extending into the interior of said cup-shaped article;

said biasing means including a first linear portion extending outwardly from said interconnecting means into a curved portion that curves upwardly and inwardly into a second linear portion that extends inwardly into the knee portion of said article engaging means;

said second linear portion of said biasing means extends a greater distance inwardly than the distance that said first linear portion of said biasing means extends outwardly.

22. An article holder for securing a cup-shaped article to a dish rack as recited in claim 21 wherein said interconnecting means, article engaging means and biasing means are integrally formed to provide a unitary construction.

23. An article holder for securing a cup-shaped article to a dish rack as recited in claim 22 wherein said interconnecting means, article engaging means and biasing means are integrally formed of a resilient material.

24. An article holder for securing a cup-shaped article to a dish rack as recited in claim 21 wherein the linear portion of said article engaging means extends upwardly and slightly outwardly from said knee portion.

25. An article holder for securing a cup-shaped article to a dish rack as recited in claim 21 wherein said linear portion, said knee portion, and said first and second linear portions comprise a first leg, and wherein said article holder includes a substantially identical leg horizontally spaced from and generally parallel to said first leg.

26. An article holder for securing a cup-shaped article to a dish rack, said cup-shaped article having a sidewall defining the interior of the article, said dish rack having at least one horizontally extending tine and at least one member extending above said tine comprising:

means for interconnecting said holder with said dish rack;

means for engaging a cup-shaped article, said article engaging means having a knee portion curving generally upwardly into a linear portion; and means for biasing said knee portion of said article engaging means towards said dish rack member to hold the sidewall of the cup-shaped article between said knee portion and said dish rack member with the linear portion of said article engaging means extending into the interior of said cup-shaped article;

said interconnecting means including means for snapping said article holder onto said horizontally extending tine so as to allow said article holder to be removed from said dish rack.

27. An article holder for securing a cup-shaped article to a dish rack, said cup-shaped article having a sidewall defining the interior of the article, said dish rack having at least one horizontally extending tine and at least one member extending above said tine comprising:

means for interconnecting said holder with said dish rack;

means for engaging a cup-shaped article, said article engaging means having a knee portion curving generally upwardly into a linear portion; and means for biasing said knee portion of said article engaging means towards said dish rack member to hold the sidewall of the cup-shaped article between said knee portion and said dish rack member with the linear portion of said article engaging means extending into the interior of said cup-shaped article;

said interconnecting means including a hinge member for interconnecting said article holder with said horizontally extending tine such that said article holder is pivotable about said horizontally extending tine.

28. An article holder for securing a cup-shaped article to a dish rack as recited in claim 27 wherein said biasing means including a first linear portion extending outwardly from said interconnecting means into a curved portion that curves upwardly and inwardly into a second linear portion that extends inwardly into the knee portion of said article engaging means.

29. An article holder for securing a cup-shaped article to a dish rack as recited in claim 28 wherein said second linear portion of said biasing means extends a greater distance inwardly than the distance that said first linear portion of said biasing means extends outwardly.

30. An article holder for securing a cup-shaped article to a dish rack as recited in claim 27 wherein said interconnecting means, article engaging means and biasing means are integrally formed to provide a unitary construction.

31. An article holder for securing a cup-shaped article to a dish rack as recited in claim 26 wherein said biasing means includes a first linear portion extending outwardly from said interconnecting means into a curved portion that curves upwardly and inwardly into a second linear portion that extends inwardly into the knee portion of said article engaging means.

32. And recycle holder for securing a cup-shaped article to a dish rack as recited in claim 31 wherein said second linear portion of said biasing means extends a greater distance inwardly than the distance that said first linear portion of said biasing means extends outwardly.

33. An article holder for securing a cup-shaped article to a dish rack as recited in claim 26 wherein said interconnecting means, article engaging means and biasing means are integrally formed to provide a unitary construction.

* * * * *